US008353606B2

(12) United States Patent
Jeong

(10) Patent No.: US 8,353,606 B2
(45) Date of Patent: Jan. 15, 2013

(54) STREETLIGHT

(75) Inventor: Tae Ho Jeong, Anyang-si (KR)

(73) Assignee: Jinsung CNC Co. Ltd. (KR)

( * ) Notice: Subject to any disclaimer, the term of this patent is extended or adjusted under 35 U.S.C. 154(b) by 266 days.

(21) Appl. No.: 12/882,401

(22) Filed: Sep. 15, 2010

(65) Prior Publication Data

US 2012/0002413 A1 Jan. 5, 2012

(30) Foreign Application Priority Data

Jul. 2, 2010 (KR) ..... 10-2010-0063685

(51) Int. Cl.
*F21V 29/00* (2006.01)
*F21V 7/00* (2006.01)
*F21S 8/00* (2006.01)

(52) U.S. Cl. ..... 362/249.02; 362/218; 362/294; 362/373; 362/240; 362/241

(58) Field of Classification Search ..... 362/218, 362/240, 247, 249.02, 294, 298, 373, 374, 362/375, 431
See application file for complete search history.

(56) References Cited

U.S. PATENT DOCUMENTS

| | | | | |
|---|---|---|---|---|
| 7,513,639 | B2 * | 4/2009 | Wang | 362/218 |
| 7,699,498 | B2 * | 4/2010 | Zheng | 362/249.02 |
| 7,744,247 | B2 * | 6/2010 | Zhang et al. | 362/249.02 |
| 7,758,211 | B2 * | 7/2010 | Zheng et al. | 362/249.02 |
| 7,794,116 | B2 * | 9/2010 | Shuai et al. | 362/294 |
| 8,057,074 | B2 * | 11/2011 | Fang | 362/373 |

* cited by examiner

*Primary Examiner* — Stephen F Husar
*Assistant Examiner* — James Cranson, Jr.
(74) *Attorney, Agent, or Firm* — Prince Heneveld LLP

(57) ABSTRACT

A streetlight installed on a street or a sidewalk in order to radiate light includes a base plate detachably fixed to a streetlight body using a clamp and a reflector fixed to one side of the base plate. The reflector has a first slope having a plurality of LEDs mounted thereon, and a second slope having a reflective film mounted thereon, the reflective film arranged opposite the LEDs. The reflector provides illumination by reflecting light, emitted from the LEDs, to the outside. A heat dissipation pad is disposed between the base plate and the reflector. The heat dissipation pad insulates the LEDs from external high-voltage EMS. A cover made of a translucent material has a recess in the central portion thereof to house the reflector therein, and fixes both the reflector and the heat dissipation pad to the base plate. Heat dissipation fins are fixed to the base plate.

8 Claims, 6 Drawing Sheets

STREETLIGHT

CROSS REFERENCE TO RELATED APPLICATION

The present application claims priority from Korean Patent Application Number 10-2010-63685 filed on Jul. 2, 2010, the entire contents of which application are incorporated herein for all purposes by this reference.

BACKGROUND OF THE INVENTION

1. Field of the Invention

The present invention relates to a streetlight incorporating a plurality of LED modules, and more particularly to a streetlight in which metal printed circuit boards (PCBs) and reflective films are arranged at predetermined intervals on a corrugated reflector, with one PCB and a corresponding reflective film arranged opposite and facing each other at a predetermined angle so that light is radiated outside, and heat dissipation fins are disposed around the reflector in order to efficiently remove heat generated by light emitting diodes (LEDs) by dissipating it. The streetlight exhibits better illumination and heat-dissipation efficiency than streetlights of the related art, can illuminate the surroundings by dispersing light further to the outside, and can be installed by easily modifying a streetlight of the related art, using its facilities in their current state.

2. Description of Related Art

In general, streetlights are installed on streets or sidewalks in order to increase the convenience of drivers and pedestrians at night.

As shown in FIGS. 1A and 1B, such a streetlight 1 of the related art uses a lamp device 10, such as a halogen lamp, a mercury lamp, or a metal halide lamp, as a light source. The streetlight 1 of the related art has a reflecting shade 20 that is configured to reflect light, emitted from the lamp device 10, to the outside. In addition, a translucent cover 32 is mounted in front of the lamp device 10 in order to protect the lamp device 10.

However, the streetlight 1 of the related art has drawbacks, such as low illumination efficiency, a short lifespan, and the release of pollutants when the lamp device 10 is discarded, which are attributable to the characteristics of the lamp device 10.

In addition, since the streetlight 1 of the related art is turned on using an electronic stabilizer (not shown) integrated therewith, both the streetlight 1 and the electronic stabilizer, which is integrated with the streetlight 1, must be replaced if the electronic stabilizer operates abnormally due to aging or if the streetlight burns out.

Therefore, in order to improve illumination efficiency and enhance longevity and convenience in maintenance such that they are better than those of the streetlight 1 of the related art, the development of streetlights using light emitting diodes (LEDs) as a light source has been recently undertaken.

Streetlights using LEDs as a light source are gaining attention, since they exhibit higher energy efficiency and have a longer lifespan than the streetlights of the related art, in addition to which they release few pollutants. In particular, as environment-friendly products are getting more popular, more streetlights of the related art are being replaced with LED-type streetlights.

However, although LEDs, used as a light source, confer advantages such as excellent power efficiency and environment friendliness, LEDs have drawbacks in that their lifespan is reduced and their light-emitting efficiency is degraded when the temperature rises over the rated functioning temperature. Therefore, in order to increase the power of LEDs, it is still required to develop a technology that enables the LEDs to operate at as low a temperature as possible by efficiently dissipating heat generated by the LEDs.

The information disclosed in this Background of the Invention section is only for the enhancement of understanding of the background of the invention and should not be taken as an acknowledgment or any form of suggestion that this information forms a prior art that would already be known to a person skilled in the art.

BRIEF SUMMARY OF THE INVENTION

Various aspects of the present invention provide a streetlight that can be installed by easily modifying a streetlight of the related art using its facilities in their current state and exhibits better illumination and heat-dissipation efficiency than a streetlight of the related art, so that it can light the street more brightly.

Also provided is a streetlight in which the longevity and maintenance are greatly improved such that maintenance is not required for a long time, and convenience in maintenance is greatly improved such that a lighting module can be simply replaced by detaching and attaching it using clamps.

In one aspect of the present invention, the streetlight installed on a street or a sidewalk in order to radiate light includes a base plate, which is detachably fixed to a streetlight body using a clamp, and a reflector fixed to one side of the base plate. The reflector has a first slope having a plurality of light emitting diodes (LEDs) mounted on one side thereof, and a second slope having a reflective film mounted thereon, the reflective film arranged opposite the LEDs. The reflector provides illumination by reflecting light, emitted from the LEDs, to the outside. A heat dissipation pad is disposed between the base plate and the reflector. The heat dissipation pad insulates the LEDs, which function as a light source, from external high-voltage electromagnetic surges. The streetlight also includes a cover made of a translucent material. The cover has a recess in the central portion thereof to house the reflector therein, and fixes both the reflector and the heat dissipation pad to the base plate using a fastening means that includes a fixing bolt. The streetlight also includes a heat dissipation section having a plurality of heat dissipation fins on peripheral portions of the cover, the heat dissipation fins fixed to the base plate, whereby heat is dissipated to the outside.

According to an exemplary embodiment of the invention, the base plate can be an aluminum plate having a size identical with an underside of the streetlight body, and a periphery of the base plate can be detachably fixed to the streetlight body by a plurality of toggle clamps, the toggle clamps being mounted on the streetlight body.

According to an exemplary embodiment of the invention, the reflector can be made of an aluminum material having excellent heat conductivity. A plurality of first slopes and a plurality of second slopes can be provided to form a plurality of slope pairs, in which the slope pairs are arranged in parallel and opposing each other, each of the slope pairs includes one first slope and one second slope, which are arranged to define an upside-down "V" shape. The first slope can have a mounting recess defined thereon, with a metal printed circuit board having excellent heat conductivity fitted into the mounting recess, and the second slope can have a bend that varies a slope angle of the reflecting film to disperse light. The first slope can be oriented to face a center of the reflector and the second slope can be oriented to face outside from the center of the reflector. Thereby, light, emitted from the light emitting diodes on the first slope toward the reflecting film, is dispersed outside of the reflector.

According to an exemplary embodiment of the invention, the reflector can have a plurality of plate-like heat dissipating portions formed opposite the first and second slopes, the heat dissipating portions increasing a contact area with the heat dissipation pad, and a fitting skirt protruding from a periphery thereof with an "L" shaped cross section, and is fixed to the base plate using the cover.

According to an exemplary embodiment of the invention, the cover can be made of a transparent polycarbonate material, and has a flange formed on a periphery thereof with an "L" shaped cross section. A fitting recess can be formed in an inner circumference of the flange so that the fitting skirt having an "L" shaped cross section, formed on the periphery of the reflector, is fixedly fitted into the fitting recess. The heat dissipation pad disposed between the base plate and the reflector can be made of a material having excellent heat conductivity and has a size equal to the reflector. Thereby, the heat dissipation pad can be interposed and fixed between the base plate and the reflector when a plurality of fixing bolts fix the cover to the base plate by extending through the flange of the cover.

According to an exemplary embodiment of the invention, the streetlight can further include a heat dissipation section made of an aluminum material having excellent heat conductivity. The heat dissipation section can be mounted on the base plate using a fixing bolt and be fixed to the base plate by forming an interval that insulates fixing bolts, which fix the cover, from external electromagnetic surges.

According to an exemplary embodiment of the invention, the metal printed circuit board can be connected with an electrical line, through which electric power is supplied from outside, and which is connected to a terminal of a power supply, which is disposed in a space inside the streetlight body. A detachable coupling between the electrical line and the terminal can be established by a connector so that power is supplied to the metal printed circuit board.

As set forth above, the base plate is mounted on the streetlight body of the related art via the clamps, and the PCBs having a plurality of LEDs and the reflective films are mounted on the base plate in order to light the street or the sidewalk by reflecting light, emitted from the LEDs, to the outside. Therefore, the streetlight of the invention exhibits better illumination and heat-dissipation efficiency than the streetlight of the related art, and has an excellent effect in that the streetlight of the related art can be modified into an improved streetlight by using its existing facilities in their current state.

In addition, since the streetlight of the invention uses the LEDs as a light source and efficiently removes heat generated during the operation of the LEDs by dissipating it to the outside, neither the light-emitting performance nor the light-emitting efficiency of the LED is lowered. Therefore, since the light-emitting performance and longevity of the LED is improved, maintenance is not necessary for a long time. When the lighting module is to be replaced, it can be easily replaced using the clamps. This provides an excellent effect in that convenience in maintenance is greatly improved.

The methods and apparatuses of the present invention have other features and advantages which will be apparent from, or are set forth in greater detail in the accompanying drawings, which are incorporated herein, and in the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments that may be included within the spirit and scope of the invention as defined by the appended claims.

Figure 1A:
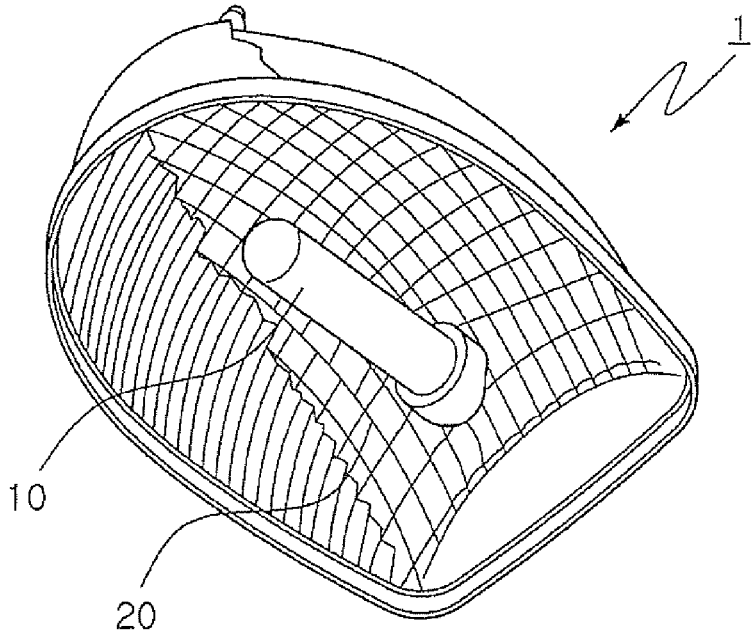
PRIOR ART FIG. 1A
FIG. 1A is a perspective view showing a streetlight of the related art, which has a metal halide lamp.
Figure 1B:
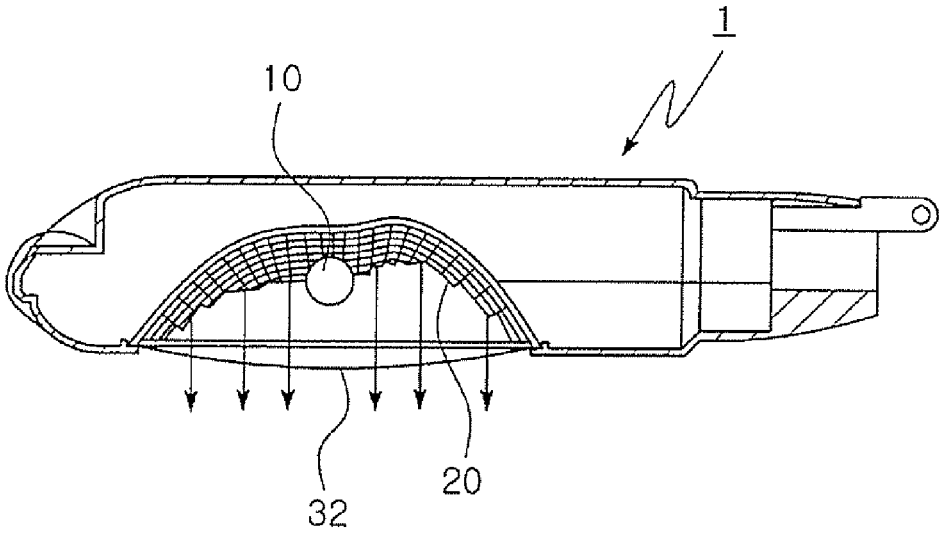
PRIOR ART FIG. 1B
FIG. 1B is a partially cutaway cross-sectional view of the streetlight shown in FIG. 1B.
Figure 2:
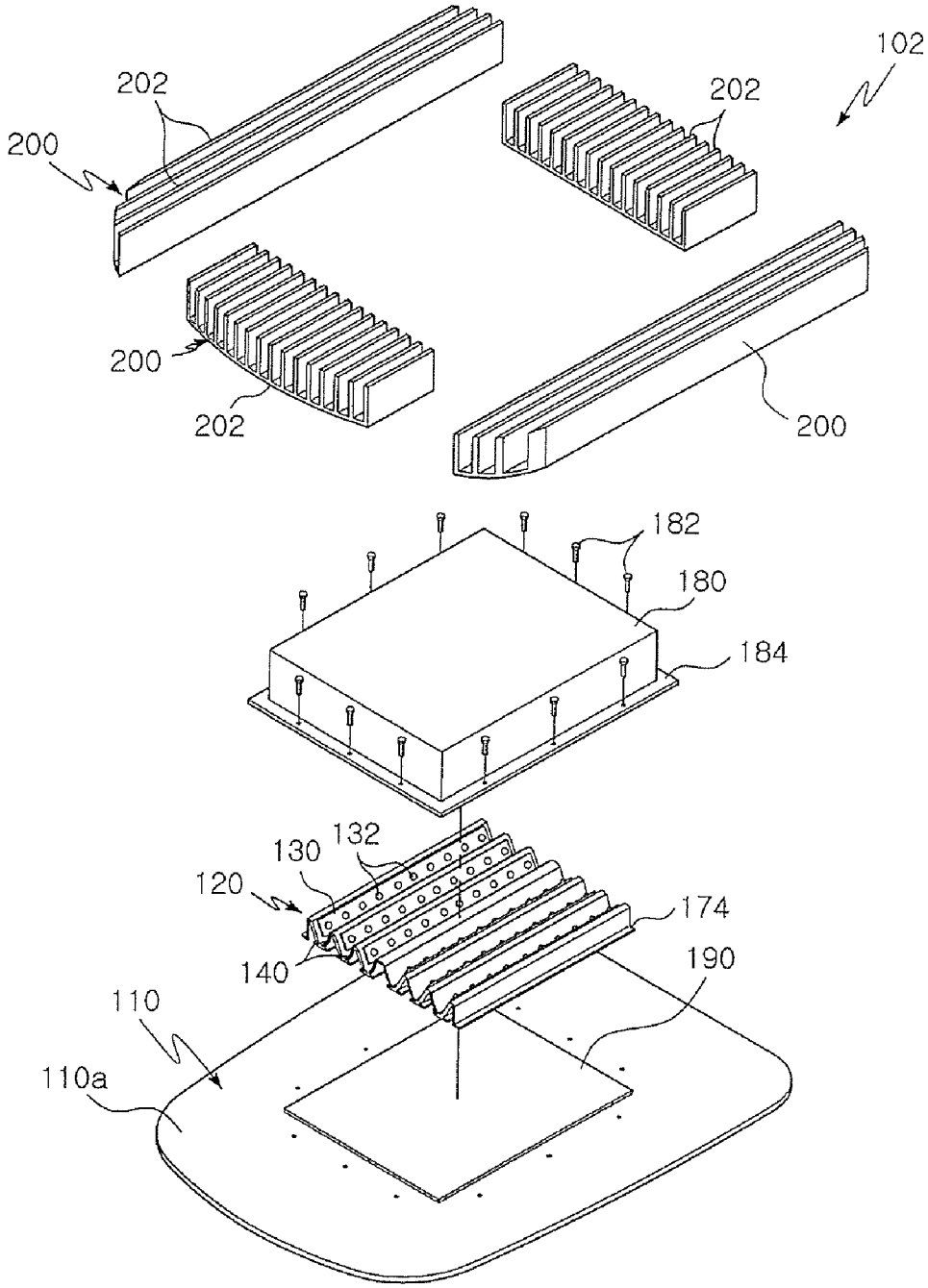
FIG. 2 is an exploded perspective view showing a lamp device of a streetlight according to an exemplary embodiment of the invention.
Figure 3A:
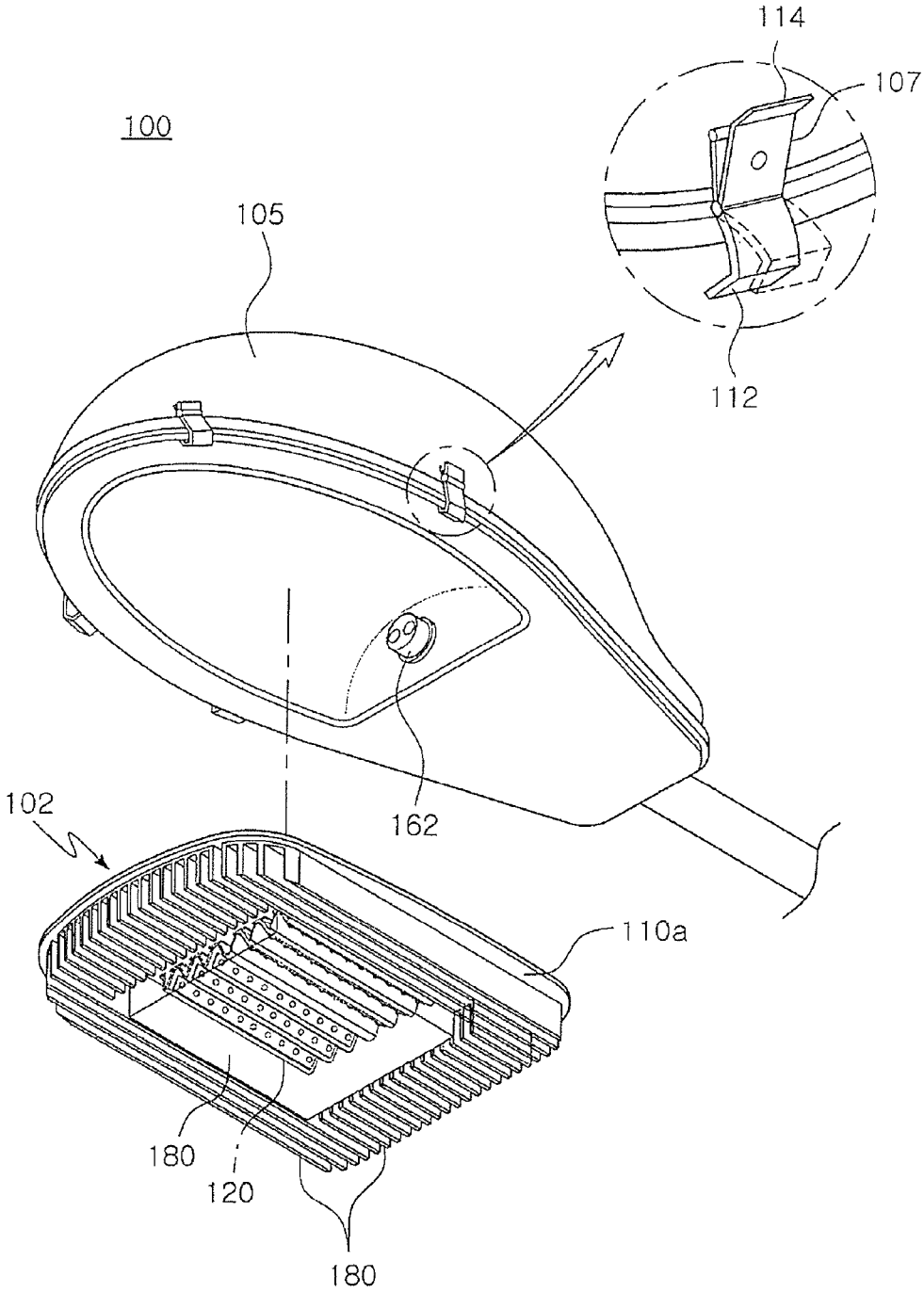
FIG. 3A is an exploded perspective view showing an attachment structure that fixes the lamp device shown in FIG. 2 to a streetlight body of the related art.

Referring to FIG. 2, a lamp device 102 of a streetlight 100 according to an exemplary embodiment of the invention has a modular mounting structure. As shown in FIG. 3A, the lamp device 102 of the streetlight 100 includes a base plate 110, which is detachably fixed to a streetlight body 105 using toggle clamps 107.

The base plate 110 is formed as an aluminum plate that is the same size as the bottom surface of the streetlight body 105 of the related art. The base plate 110 is detachably fixed at the periphery thereof using the toggle clamps 107, which are mounted on the streetlight body 105.

The base plate 110 is configured such that it is made of an aluminum material having excellent heat conductivity, and also such that its periphery 110*a* is easily attached to or detached from the streetlight body 105 of the related art using the toggle clamps 107.

As above, each of the toggle clamps 107 is configured such that a hook 112 is provided at the lower end thereof and a swing lever 114 is provided at the upper end thereof. When the swing lever 114 is turned upward with the hook 112 hung on the periphery of the base plate 110, the base plate 110 can be easily mounted on the streetlight body 105.

In addition, a reflector 120 is fixed to one side of the base plate 110. On one side of the reflector 120, a plurality of first slopes 124 and a plurality of second slopes 126 corresponding to the first slopes 124 are provided. A light emitting diode (LED) 132 is provided on a respective first slope 124, and a reflective film 140 is mounted on a respective second slope 126. With this configuration, the reflector 120 provides illumination by reflecting light, emitted from the LEDs 132, to the outside.

Figure 3B:
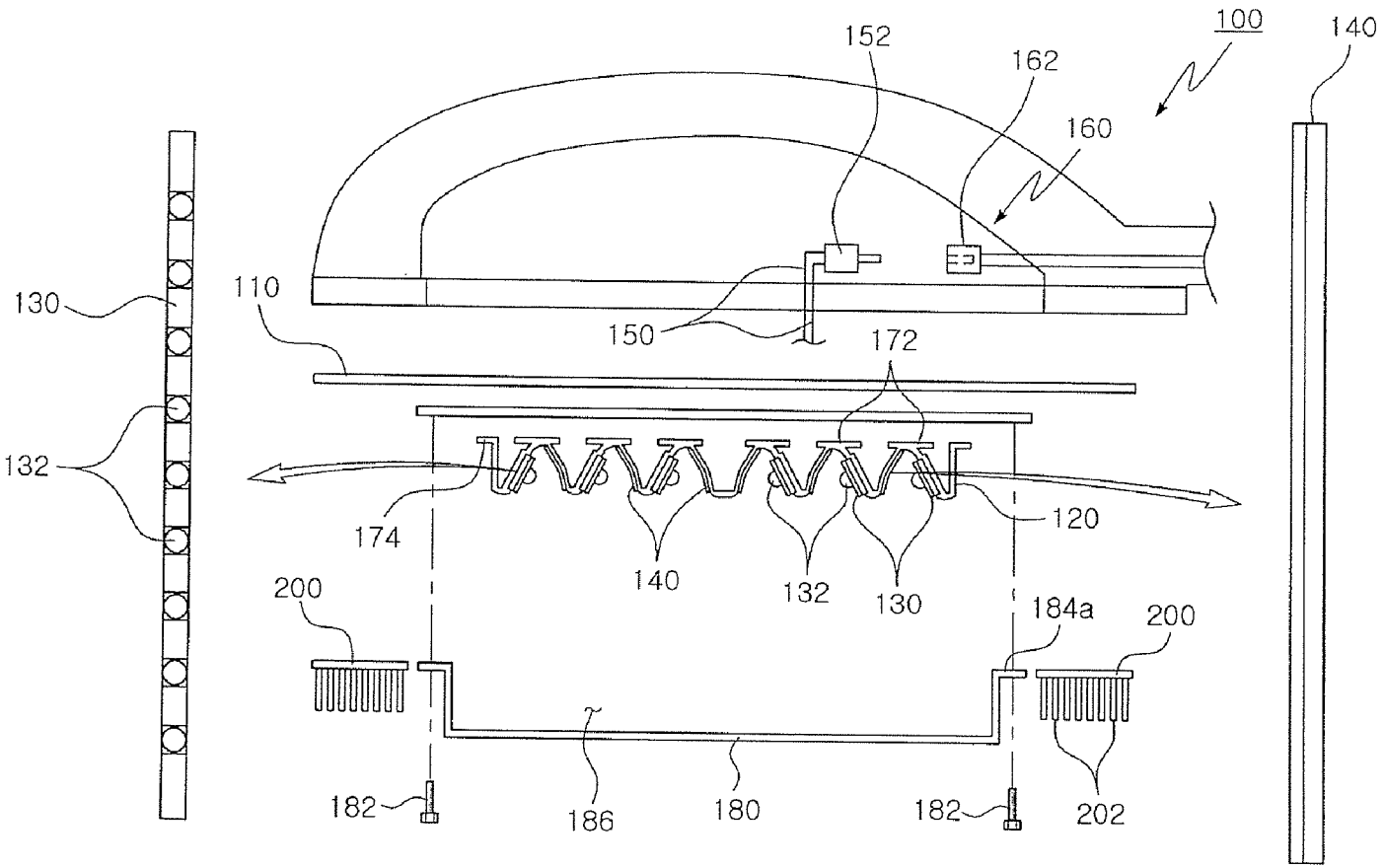
FIG. 3B is an exploded perspective view of the attachment structure shown in FIG. 3B.

The reflector 120 is made by injection molding an aluminum material having excellent heat conductivity. As shown in FIG. 3B, pairs of the first and second slopes 124 and 126 on one side of the reflector 120 are arranged parallel to and opposing each other, with a respective pair of the first and second slopes 124 and 126 defining an upside-down "V" shape (i.e., a "Λ" shape).

In addition, a metal printed circuit board (PCB) 130, having excellent heat conductivity, is mounted on a respective first slope 124, and a plurality of the LEDs 132 is mounted on one side of the PCB 130, arranged in a line. When electric power is applied, the LEDs 132 are turned on, thereby emitting light.

The metal PCB 130 is connected with an electrical line 150, through which electric power is supplied from outside. As shown in FIG. 3B, the electrical line 150 is connected to a terminal 162 of a power supply 160, which is disposed in the space inside the streetlight body 105. Specifically, a detachable coupling between the electrical line 150 and the terminal 162 is established by a connector 152 so that power is supplied to the PCB 130. Due to this detachable connecting structure, it is possible to easily connect the PCB 130 to an external power source in order to turn on the LEDs 130.

In addition, the metal PCB 130 is fixedly fitted into a mounting recess 124*a* of the first slope 124, and the reflective film 140 is mounted on the second slope 126 of the reflector 120 such that it is opposite the first slope 124.

Since a pair of the first and second slopes 124 and 126 is arranged in the form of an upside-down "V" (i.e., "Λ") light emitted from the LEDs 132 disposed on the first slope 124 is radiated to the outside after having been reflected from the reflective film 140 mounted on the second slope 126, and the second slope 126 has a bend 126*a* that varies the slope angle of the reflective film 140 so that light can be diffused in the state in which it is further dispersed outward.

In addition, the reflector 120 has a symmetrical structure, with the first and second slopes 124 and 126 arranged on both sides of the central portion P of the reflector 120 to oppose each other. As shown in FIG. 3B, a respective first slope 124 faces the central portion P of the reflector 120, and a respective second slope 126 faces outward from the central portion P of the reflector 120.

Thanks to this structure, when light is emitted from the LEDs 132 on the first slope 124 and reflected from the reflective film 140 of the second slope 126, it is directed outward from the central portion P of the reflector 120. Accordingly, light is further dispersed while it is being radiated outward, and is thus radiated over a wide area.

The reflector 120 has a plurality of planar heat-dissipating portions 172 opposite the first and second slopes 124 and 126. The planar heat-dissipating portions 172 are configured to increase contact areas with a heat dissipation pad 190. The reflector 120 also has fitting skirts 174 protruding from the periphery thereof, the fitting skirts 174 having an "L" shaped cross section, so that the reflector 120 can be integrally fixed to the base plate 110 using a cover 180, as will be described later.

In addition, in the streetlight 100, the heat dissipation pad 190 is disposed between the base plate 110 and the reflector 120 to insulate the LEDs 132, functioning as a light source, from external high-voltage electromagnetic surges (EMS).

The heat dissipation pad 190 is made of a material having excellent heat transfer characteristics, and is the same size as the reflector 120. As will be described later, when the base plate 110 is fixed to the cover 180 by a plurality of fixing bolts 182 penetrating a flange 184 of the cover 180, the heat dissipation pad 190 is interposed and fixed between the reflector 120 and the base plate 110 such that it protects the LEDs 132, functioning as a light source, from an external high-voltage EMS by insulating the LEDs 132.

In addition, in the streetlight 100, the cover 180 is fixed to the base plate 110 such that the reflector 120 and the heat dissipation pad 190 are disposed inside the cover 180. The cover 180 is made of a translucent material, such as transparent polycarbonate (PC), such that light emitted from the LEDs 132 can be efficiently radiated to the outside through the cover 180.

The cover 180 has a recess 186 in the central portion thereof to house the reflector 120 therein, and both the reflector 120 and the heat dissipation pad 190 are fixed to the base plate 110 by a fastening means including the fixing bolts 182.

Figure 4A:
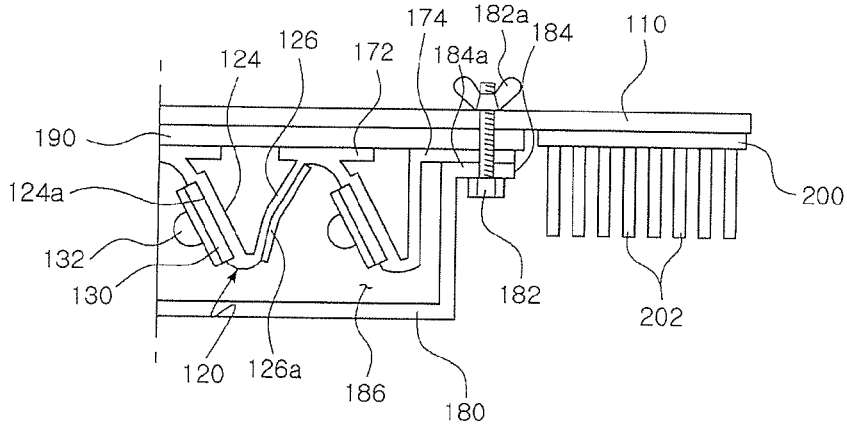
FIG. 4A is an enlarged view of a part of the streetlight of the invention showing the structure by which the reflector and the heat dissipation pad are integrally fixed using the cover.

As shown in FIGS. 3B and 4A, the cover 180 has a flange 184 defined on the circumference thereof, the flange 184 having an "L" shaped cross section, and is fixed to the base plate 110 by the fastening means including a plurality of the fixing bolts 182, the fastening means coupled with the flange 184.

The cover 180 has fastening recesses 184*a* in the inner circumference of the flange 184, so that the fitting skirts 174, which have an "L" shaped cross section and are formed on the circumference of the reflector 120, are fixedly fitted into the fastening recesses 184*a*.

In this configuration, the fitting skirts 174, which have an "L" shaped cross section and are formed on the circumference of the reflector 120, conform to the fastening recesses 184*a* in the inner circumference of the flange 184 of the cover 180, so that, when the reflector 120 is positioned in the space inside the cover 180, the cover 180 can be fastened with the base plate 110 by screwing a plurality of fixing bolts 182 into the flange 184.

As such, in the streetlight 100 of this embodiment, when the reflector 120 and the heat dissipation pad 190 are fixed integrally to the base plate 110 using the cover 180 and several fixing bolts 182, the reflector 120 and the heat dissipation pad 190 can be easily fastened to the base plate 110 using the cover 180. This provides a more simple structure, thereby making operation easier.

In addition, the streetlight 100 of this embodiment includes heat dissipation sections 200, which are fixed to the base plate 110 around the cover 180. Each of the heat dissipation sections 200 has a plurality of heat dissipation fins 202 to dissipate heat outside.

The heat dissipation sections 200 are made of an aluminum material having excellent heat conductivity, and are integrally mounted to the base plate 110 via fixing bolts 204.

The heat dissipation sections 200 are fixed to the base plate 110 at an interval L so that the fixing bolts 182, which fix the cover 180, can be insulated from external electromagnetic surges (EMS).

In the streetlight 100 of this embodiment, configured as above, the lamp device 102 can be easily mounted on a streetlight 1 of the related art.

Figure 4B:
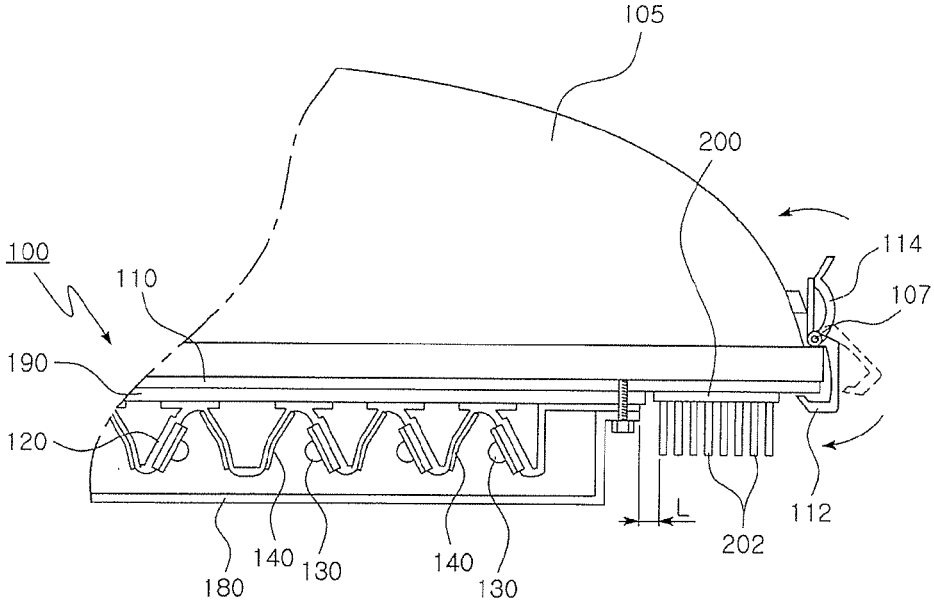
FIG. 4B is an enlarged view of a part of the streetlight of the invention showing the structure by which the base plate is mounted to a streetlight body of the related art using toggle clamps.

In this case, the streetlight body 105 of the streetlight 100 mounted on the streetlight 1 of the related art corresponds to a streetlight body of the related art from which a cover 32 of the related art is detached. As shown in FIG. 4B, the periphery of the base plate 110 is fixed by being hooked by the toggle clamps 107, which are mounted along the periphery of the streetlight body 105, in the same fashion as for the cover 32 of the related art.

This configuration makes it possible to easily replace the streetlight 1 of the related art. It is possible to mount the streetlight 100 of this embodiment utilizing existing facilities in their current state.

Figure 5:
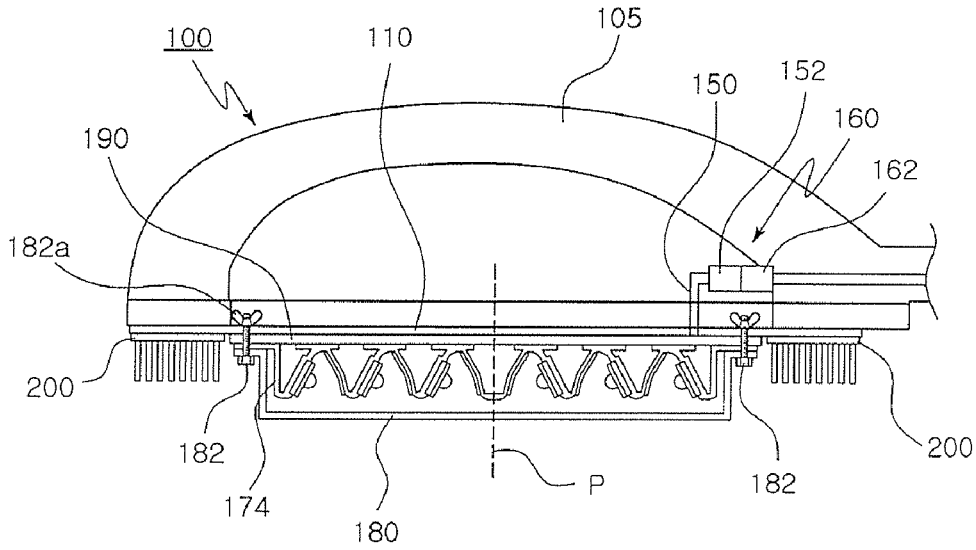
FIG. 5 is a cross-sectional view of the streetlight of the invention, which is mounted using the streetlight body of the related art.

As shown in FIG. 5, in the streetlight 100 of this embodiment, which can be mounted on the streetlight body 105 of the related art, the reflector 120 and the heat dissipation pad 190 are integrally fixed on the central portion of the base plate 110 using the cover 180, and a plurality of the heat dissipation sections 200, each including the heat dissipation fins 202, is arranged on the periphery of the base plate 110.

In this configuration, a plurality of the metal PCBs 130 on the reflector 120 is detachably coupled with the terminal 162 of the power supply 160 in the inner space of the streetlight body 105, via the connector 152, so that electrical power is supplied to the metal PCBs 130.

Figure 6:
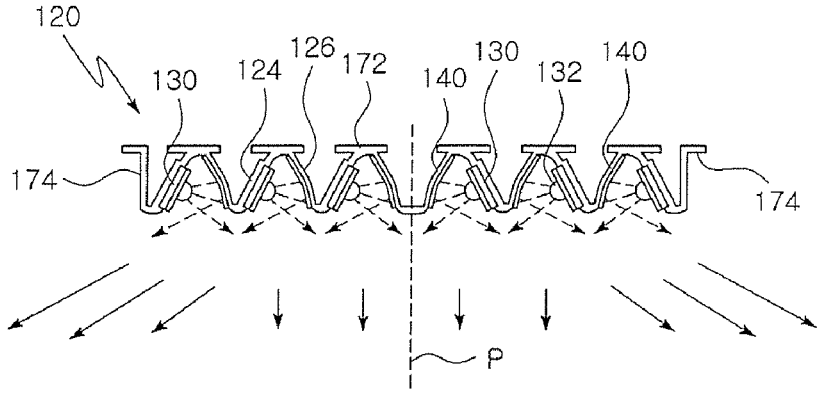
FIG. 6 is an explanatory view of the streetlight of the invention in which light is dispersed and radiated outward using the LEDs and the reflective films mounted on the reflector.

Therefore, in the reflector 120, when a plurality of LEDs 132 on the metal PCBs 130 emit light, the reflecting films 140 reflect light to the outside, as shown in FIG. 6.

In this case, the reflector 120 has a symmetrical structure in which the first slopes 124 and the second slopes 126 are positioned opposite each other on both sides of the center P of the reflector 120. The first slopes 124 face the center P of the reflector 120, whereas the second slopes 126 face away from the center P of the reflector 120.

Therefore, due to this configuration, light, which is emitted from a plurality of LEDs 132 on the first slopes 124 to the reflecting films 140 on the second slopes 126, is reflected outward from the center P of the reflector 120, and through this process, light from the LEDs 132 is further dispersed outward to illuminate a wide area. In addition, this configuration serves to efficiently dissipate a large amount of heat, which is generated during the emission of light by the LEDs 132, to the outside through the heat dissipation fins 202 of the heat dissipation sections 200.

That is, the metal PCBs 130, on which the heat-generating LEDs 130 are mounted, and the reflector 120 are made of an aluminum material having excellent heat conductivity, and a plurality of the plate-like heat-dissipating portions 172, which serve to increase the contact area with the heat dissipation pad 190, is provided on the rear surface of the reflector 120. Therefore, this configuration has excellent heat transfer capability.

In addition, the heat dissipation pad 190 and the base plate 110 are made of a material having excellent heat conductivity, such that heat generated by the LEDs 132 is transferred to the heat dissipation fins 202 of the heat dissipation sections 200 through the reflector 120, the heat dissipation pad 190, and the base plate 110. The heat is then dissipated to the outside, thereby preventing the LEDs 132 from being overheated.

As such, the streetlight 100 of this embodiment is configured such that the base plate 110 is attached to and detached from the streetlight body 105 of the related art using the clamps 107. Accordingly, it is possible to utilize existing streetlight facilities in their current state, and it is very desirable in terms of the utilization of existing facilities.

In addition, the PCBs 130, on which a plurality of the LEDs 132 is mounted, and the reflecting films 140 are provided on the reflector 120 to reflect light emitted from the LEDs 132 so that the light illuminates a street or sidewalk. In this process, since the reflector 120 has a symmetric structure in which the first slopes 124 and the second slopes 126 are arranged opposite each other on both sides of the center P of the reflector 120, light emitted from a plurality of the LEDs 132 toward the reflecting films 140 is reflected outward from the center P of the reflector 120, thereby illuminating the outside across a wider range.

In addition, since the streetlight of this embodiment can efficiently prevent the LEDs 132 from being overheated by raising the effectiveness with which heat, generated from the LEDs 132, is dissipated, the longevity and maintenance of the streetlight 100 are improved, so that additional maintenance is not necessary for a long time. Furthermore, it is possible to easily replace a lighting module in order to greatly improve the convenience of maintenance.

When the lighting module is to be replaced, it can be easily replaced. This provides an excellent effect in that the convenience of maintenance is greatly improved.

The foregoing descriptions of specific exemplary embodiments of the present invention have been presented for the purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A streetlight installed on a street or a sidewalk in order to radiate light, comprising:

a base plate detachably fixed to a streetlight body by a clamp;

a reflector fixed to one side of the base plate, wherein the reflector has a first slope having a plurality of light emitting diodes mounted on one side thereof and a second slope having a reflective film mounted thereon, the reflective film arranged opposite the light emitting diodes, wherein the reflector provides illumination by reflecting light, emitted from the light emitting diodes, outside;

a heat dissipation pad disposed between the base plate and the reflector, wherein the heat dissipation pad insulates the light emitting diodes, functioning as a light source, from external high-voltage electromagnetic surge;

a cover made of a translucent material, wherein the cover has a recess in a central portion thereof to house the reflector therein, and fixes both the reflector and the heat dissipation pad to the base plate by a fastening means including a fixing bolt; and a heat dissipation section including a plurality of heat dissipation fins on peripheral portions of the cover, the heat dissipation fins fixed to the base plate, whereby heat is dissipated outside.

2. The streetlight according to claim 1, wherein the base plate comprises an aluminum plate having a size identical with an underside of the streetlight body, and a periphery of the base plate is detachably fixed to the streetlight body by a plurality of toggle clamps, the toggle clamps being mounted on the streetlight body.

3. The streetlight according to claim 1, wherein the reflector is made of an aluminum material, wherein a plurality of first slopes and a plurality of second slopes are provided to form a plurality of slope pairs, wherein the slope pairs are arranged in parallel and opposing each other, each of the slope pairs includes one first slope and one second slope, the first slope has a mounting recess defined thereon, with a metal printed circuit board fitted into the mounting recess, and the second slope has a bend that varies a slope angle of the reflecting film to disperse light.

4. The streetlight according to claim 3, wherein the first slope is oriented to face a center of the reflector and the second slope is oriented to face outside from the center of the reflector, whereby light, emitted from the light emitting diodes on the first slope toward the reflecting film, is dispersed outside of the reflector.

5. The streetlight according to claim 3, wherein the reflector has a plurality of plate-like heat dissipating portions formed opposite the first and second slopes, the heat dissipating portions increasing a contact area with the heat dissipation pad, and a fitting skirt protruding from a periphery thereof, and is fixed to the base plate using the cover.

6. The streetlight according to claim 5, wherein the cover is made of a transparent polycarbonate material, and has a flange formed on a periphery thereof, wherein a fitting recess is formed in an inner circumference of the flange so that the fitting skirt, formed on the periphery of the reflector, is fixedly fitted into the fitting recess, and the heat dissipation pad disposed between the base plate and the reflector is made of a material having excellent heat conductivity and has a size equal to the reflector, whereby the heat dissipation pad is interposed and fixed between the base plate and the reflector when a plurality of fixing bolts fix the cover to the base plate by extending through the flange of the cover.

7. The streetlight according to claim 1, wherein the heat dissipation section is made of an aluminum material having excellent heat conductivity, and is mounted on the base plate using a fixing bolt, and is fixed to the base plate by forming an interval that insulates fixing bolts, which fix the cover, from external electromagnetic surges.

8. The streetlight according to claim 3, wherein the metal printed circuit board is connected with an electrical line, through which electric power is supplied from outside, and which is connected to a terminal of a power supply, which is disposed in a space inside the streetlight body, and a detachable coupling between the electrical line and the terminal is established by a connector so that power is supplied to the metal printed circuit board.

* * * * *